US005401554A

United States Patent [19]

Armen

[11] Patent Number: 5,401,554

[45] Date of Patent: Mar. 28, 1995

[54] PROCESS FOR THE MANUFACTURE OF A STAIN RESISTANT MELT COLORED CARPET

[75] Inventor: Ardy Armen, Anderson, S.C.

[73] Assignee: BASF Corporation, Parsippany, N.J.

[21] Appl. No.: 171,137

[22] Filed: Dec. 21, 1993

[51] Int. Cl.[6] ..... B32B 3/02

[52] U.S. Cl. ..... 428/96; 8/115.54; 8/115.6; 427/389.9; 427/393.4; 428/267

[58] Field of Search ..... 8/115–116, 8/115.54; 427/389.9, 393.4; 428/96, 97, 267

[56] References Cited

U.S. PATENT DOCUMENTS 4,822,373 4/1989 Olson et al. ..... 8/115.6
5,155,178 10/1992 Windley ..... 428/97 X
5,164,261 11/1992 Windley ..... 428/364

*Primary Examiner*—Michael Lusignan
*Attorney, Agent, or Firm*—Nixon & Vanderhye

[57] ABSTRACT

A process for the manufacture of a stain resistant melt colored carpet by melt mixing a polyamide copolymer, containing sulfonate groups with a coloring agent to form a homogeneous polymer melt into fibers, tufting the fibers in a backing to form a carpet, treating the carpet with polymethacrylic acid, copolymers of polymethacrylic acid, a mixture of polymethacrylic acid and a sulfonated aromatic formaldehyde condensation product, and a reaction product of the polymerization or copolymerization of methacrylic acid in the presence of a sulfonated aromatic formaldehyde condensation product.

20 Claims, No Drawings

PROCESS FOR THE MANUFACTURE OF A STAIN RESISTANT MELT COLORED CARPET

FIELD OF THE INVENTION

The present invention relates to a process for the manufacture of a stain resistant melt colored carpet, more specifically, it relates to the treatment of a melt colored nylon copolymer carpet, with a polymethacrylic acid, copolymers of polymethacrylic acid, a mixture of polymethacrylic acid and a sulfonated aromatic formaldehyde condensation product and a reaction product of the polymerization or copolymerization of methacrylic acid in the presence of a sulfonated aromatic formaldehyde condensation product.

BACKGROUND OF THE INVENTION

Stain resistant melt colored carpet fibers are manufactured by treating nylon fibers with stain protectors.

U.S. Pat. No. 4,822,373 discloses a fibrous polyamide substrate, which has resistance to staining by acid colorants by treatment with a partially sulfonated novolak resin and polymethacrylic acid, copolymers of methacrylic acid, or combination of polymethacrylic acid and copolymers of methacrylic acid.

U.S. Pat. No. 4,940,757 discloses a stain resistant composition, prepared by polymerizing a $\alpha$-substituted acrylic acid in the presence of a sulfonated aromatic formaldehyde condensation polymer.

Another method to improve the stain resistance of nylon is to copolymerize nylon with aromatic sulfonates or their alkali metal salts.

U.S. Pat. No. 3,846,507 discloses a process for producing a fiber forming polyamide with reduced acid dye affinity by producing a polymer having certain benzene sulphonate units and then blending it with normal polyamide.

U.S. Pat. No. 4,374,641 discloses a color concentrate for coloring thermoplastic polymeric materials, which is prepared from a blend of a water-dispersable polymer like a polyamide containing benzene sulphonate and a coloring agent.

U.S. Pat. No. 4,579,762 discloses a carpet which is made from fibers of nylon 66 or nylon 6, modified to contain aromatic sulfonate units in an amount sufficient to improve the acid dye-resist properties.

U.S. Pat. No. 5,108,684 discloses a process for producing stain-resistant, pigmented nylon fibers by adding pigment to nylon copolymers containing 0.25–4.0 percent by weight of an aromatic sulfonate or an alkali metal salt thereof.

Disadvantage of the stain resistant fibers described above is, that after a treatment with a high pH shampoo, the stain protection of the fibers, treated with stain protectors is almost disappeared and the stain protection of the sulfonated nylons which have not been treated with stain protectors is decreased.

Object of the present invention was, to provide a process for the manufacture of a stain resistant melt colored carpet, which keeps a high degree of stain protection even after several treatments with a high pH shampoo.

SUMMARY OF THE INVENTION

The object of the present invention was achieved with a process for the manufacture of a stain resistant melt colored carpet, which comprises:

a) melt mixing a polyamide copolymer, containing sulfonate groups with a coloring agent to form a homogeneous polymer melt;
b) spinning the polymer melt into fibers;
c) tufting the fibers into a carpet; and
d) treating the fibers with a compound, selected from the group consisting of polymethacrylic acid, copolymers of polymethacrylic acid, a mixture of polymethacrylic acid and a sulfonated aromatic formaldehyde condensation product and a reaction product of the polymerization or copolymerization of methacrylic acid in the presence of a sulfonated aromatic formaldehyde condensation product.

DESCRIPTION OF THE PREFERRED EMBODIMENTS

In step (a) of the process for the manufacture of stain resistant melt colored carpet fibers, a polyamide copolymer, containing sulfonate groups is melt mixed with a pigment to form a homogeneous polymer melt. Suitable polyamide copolymers, containing sulfonate groups are formed by adding a sulfonated aromatic dicarboxylic acid or its alkali metal salt during polymerization of polyamide forming monomers. Sulfonated aromatic dicarboxylic acids are described for example in U.S. Pat. Nos. 3,846,507 and 4,579,762, the contents thereof are herewith incorporated by reference. A suitable sulfonated aromatic dicarboxylic acid or alkali metal salt is 5-sulfoisophthalic acid or the sodium, potassium, or lithium salt thereof. Suitable are copolymers of the following polyamides, referred to as nylon: nylon 6, nylon 6/6, nylon 6/9, nylon 6/10 nylon 6T, nylon 6/12, nylon 11, nylon 12 and copolymers thereof or mixtures thereof. Suitable polyamides can also be copolymers of nylon 6 or nylon 6/6 and a nylon salt obtained by reacting a dicarboxylic acid component such as terephthalic acid, isophthalic acid, adipic acid or sebacic acid with a diamine such as hexamethylene diamine, methaxylene diamine, or 1,4-bisaminomethylcyclohexane. Preferred are poly-$\epsilon$-caprolactam (nylon 6) and polyhexamethylene adipamide (nylon 6/6). Most preferred is nylon 6.

For the preparation of the polyamide copolymer, containing sulfonate groups, a portion of the nylon forming monomer is replaced by the equimolar amount of for example 5-sulfoisophthalic acid. In case of nylon 6,6, a portion of the adipic acid is replaced by the equimolar amount of 5-sulfoisophthalic acid.

In the case of nylon 6, a desired amount of 5-sulfoisophthalic acid is added to the caprolactam followed by copolymerization.

The nylon copolymer contains from about 0.25 to about 4% by weight of the sulfonated aromatic dicarboxylic acid of its alkali metal salt, preferably from about 0.5 to about 3% by weight and most preferred from about 1 to about 2% by weight.

Suitable coloring agents for the process of the present invention are heat-stable and chemically inert and comprise water-soluble dyes, organic solvent soluble dyes, polymer soluble dyes and pigments. Examples are a copper phthalocyanine blue, commercially available under Peacoline TM Blue from Hilton Davis; a copper phthalocyanine green, available under Monastral TM Green G from Du Pont; a copper phthalocyanine blue available under Paliofast TM LBDG-K from BASF; a dry powder copper phthalocyanine green pigment, available under Monastral TM Green G GT-751-D from DuPont; Luconyl TM Red 387 from BASF, Neozapan TM Yellow R from BASF, Filamid TM Red 841 from Ciba Geigy, Filamid TM Yellow 2732, Novoperm TM Red BL from Hoechst, Paliogen® Red K3580 from BASF and Sicotan® Yellow K2011 from BASF.

The coloring agent is used in the nylon copolymer in an amount of from about 0.001 to about 5.0% by weight based on the total weight of the nylon copolymer, preferred from about 0.005 to 4% by weight.

The melt mixing is usually performed in an extruder at a temperature of from about 225° to 400° in accordance with the melting point of the respective polymer. The coloring agent may be added to the nylon copolymer in pure form or as a batch of from about 5 to about 65% by weight of coloring agent in the same or another nylon or nylon copolymer or other polymer, preferably of from about 20 to about 35% by weight.

The homogeneous polymer melt is spun through a spinnerette into fibers, or yarns in two different ways. In a two step process the fibers are spun, treated with a finish and wound on a package as a yarn.

In a subsequent step, the yarn is drawn and texturized to form a bulked continuous filament (BCF) yarn suitable for tufting into carpets. A more preferred technique involves combining the extruded or as-spun fibers into a yarn, then drawing, texturizing and winding a package, all in a single step. This one-step method of making BCF is referred to in the trade as spin-draw-texturing.

Nylon fibers for the purpose of carpet manufacturing have deniers (denier=weight in grams of a single filament with a length of 9000 meters) in the range of about 3 to 75 denier/filament (dpf). A more preferred range for carpet fibers is from about 15 to 25 dpf.

From here, the BCF yarns can go through various processing steps well known to those skilled in the art. The fibers of this invention are tufted into a backing to form a carpet in step (c).

For the manufacture of a carpet for floor covering applications, the BCF yarns are generally tufted into a pliable primary backing. Primary backing materials are generally selected from the group comprising conventional woven jute, woven polypropylene, cellulosic nonwovens, and nonwovens of nylon, polyester, and polypropylene. The unbacked carpet is treated in step (d) with polymethacrylic acid, copolymers of polymethacrylic acid, a mixture of polymethacrylic acid and a sulfonated aromatic formaldehyde condensation product or a reaction product of the polymerization of methacrylic acid in the presence of a sulfonated aromatic formaldehyde condensation product.

Copolymers of polymethacrylic acid are formed by copolymerization of methacrylic acid with one or more comonomers, which is described for example in U.S. Pat. No. 4,822,373, the contents thereof is herewith incorporated by reference.

Preferred comonomers include mono- or polyolefinically unsaturated acids, esters, anhydrides and amides like acrylic acid, maleic acid maleic anhydride, fumaric acid, $C_1$- to $C_{18}$- alkyl or cycloalkylesters of these acids, hydroxyalkyl acrylates and methacrylates, acrylamide and methacrylamide.

Preferred is acrylic acid, methyl acrylate, ethyl acrylate, 2-hydroxyethyl methacrylate and 2-hydroxypropyl methacrylate.

Sulfonated aromatic formaldehyde condensation products are described for example in U.S. Pat. No. 4,940,757, the contents thereof is herewith incorporated by reference.

Suitable compounds are formaldehyde condensation products of formaldehyde with 4,4'- dihydroxydiphenylsulfone or with phenyl-4-sulfonic acid.

Suitable compounds are also reaction products, which are formed when methacrylic acid is polymerized or copolymerized with one or more comonomers in the presence of a sulfonated aromatic formaldehyde condensation product.

The unbacked carpet may be treated in step (d) with the aqueous solution of stain protector by any of the known application methods. The preferred application methods are exhaust application, continuous application and foam application. Preferably the unbacked carpet may be treated with stain protector by the foam application method in conjunction with the latex backing operation, described below.

In the exhaust application method, the carpet is treated in an aqueous bath with a carpet: bath weight ratio of from about 1:5 to about 1:100, preferably from about 1:10 to about 1:50 for a time period of from about 5 to about 40 minutes, preferably for a time period of from about 15 to about 20 minutes at a pH of from about 1.5 to about 6.0, preferably at a pH of from about 2.0 to about 3.0 at a temperature of from about 40° to about 90° C., preferably at a temperature of from about 70° to about 85° C. with stain protector in the bath at a concentration of from about 0.1 to about 10.0% by weight of the carpet, preferably of from about 0.2 to about 3.0% by weight. The carpet is removed from the bath, extracted and dried in an oven at a temperature of from about 50° to about 120° C.

In the continuous application, the unbacked carpet is padded through rolls like Flexnip TM rolls in a bath, wherein the pick-up of the carpet takes place at a carpet: bath weight ratio of from about 1:1 to about 1:5, preferably from about 1:2 to about 1:3. The stain protector concentration in the pad bath is from about 0.1 to about 10.0% by weight of the carpet, preferably from about 0.2 to about 3.0% and the pH is from about 1.5 to 6.0, preferably from about 2.0 to 3.0.

The carpet, then passes into a steamer, where it is steamed at a temperature of 80° to 100° C., preferably at 95° to 100° C. for 0.5 to 6.0 minutes, preferably for 1.0 to 3.0 minutes.

In the foam application, the carpet is passed under a foam applicator and a foam composition of the stain protector with a blow ratio of air: liquid of from about 10:1 to 80:1, preferably from about 40:1 to 60:1 is applied to the surface of the carpet with sufficient force to penetrate to the base of the carpet tufts at a wet pick-up of from about 5 to about 60%, preferably at a wet pick-up of from about 10 to about 30%, based on the weight of the carpet at a pH of from about 2.0 to 6.0, preferably from about 2.0 to 4.0. The concentration of the stain protector in the bath for the foam formation is from about 0.1 to about 10.0% by weight, preferably from about 0.2 to about 3.0%. The carpet is then dried in an oven at a temperature of from about 100° to about 120° C.

To lower the pH of the stain protector bath in all three applications, organic or inorganic acids like p-toluenesulfonic acid, phosphoric acid, sulfonic acid, sulfamic acid and the like are added to the bath. Preferred is sulfamic acid.

The final concentration of the stain protector on the carpet in all three application methods is from about 0.1 to about 5% by weight, based on the weight of the carpet, preferably from about 0.2 to about 3% by weight.

The primary backing is then coated with a suitable latex material such as a conventional styrene-butadiene latex, vinylidene chloride polymer, or vinyl chloride-vinylidene chloride copolymers. It is common practice to use fillers such as calcium carbonate to reduce latex costs. The final step is to apply a secondary backing, generally a woven jute or woven synthetic such as polypropylene.

It is preferred to use a woven polypropylene primary backing, a conventional styrene-butadiene (SB) latex formulation, and either a woven jute or woven polypropylene secondary carpet backing. The SB latex can include calcium carbonate filler and/or one or more of the hydrate materials listed above. The carpets are useful for floor covering applications.

EXAMPLE 1

A copolymer of nylon 6 and the lithium salt of sulfoisophthalic acid, containing 0.14% sulfur and having a relative viscosity (RV) of 2.55 (1% solution in 90% formic acid at 25° C.) was melt spun with 0.001% phthalocyanine green, 0.001% phthalocyanine blue, 0.004% carbon black and 0.2% $TiO_2$ to give a light gray shade at 265° C. on a conventional spinning machine to yield a 1115 denier 58 filament cationic dyeable yarn. The yarn had an amino end group content (AEG) of 11 meg/kg. A nylon 6 yarn (Ultramid B® from BASF AG, Germany, RV=2.7) was spun in the same manner, having an AEG of 36 meg/kg.

Yarns from the cationic dyeable and regular acid dyeable yarns were knitted into separate tubes to simulate a carpet. Four 50 gram samples from each of the knitted tubes were numbered samples 1–4 and were treated separately in 20:1 bath ratios by an Exhaust Application Method as follows:

Number 1 Samples

Untreated controls

Number 2 Samples

Regular acid dyeable and cationic dyeable samples were each treated in separate equal baths by the following procedure:

Two cold 1 liter baths were prepared with:

- 0.25 g/l Versene TM (Ethylenediaminetetraacetic acid, disodium salt; sequestering agent) from Mallinckrodt Specialty Chemicals Co. in Paris, Ky.
- 0.50 g/l NB-57LC (reaction product of the polymerization or copolymerization of methacrylic acid in the presence of a sulfonated aromatic formaldehyde condensation product) from BASF Corporation, Parsippany, N.J.
- sulfamic acid to pH 2.0.

One sample was entered into each of the baths, heated to 85° C. and run 15 minutes at 85° C., then cooled.

The samples were removed from the baths, extracted and dried in an oven at 110° C.

Then the samples were heat treated for 1 minute at 140° C. to simulate the temperature for drying of latex backing.

Number 3 Samples

Regular acid dyeable and cationic dyeable samples were each treated in separate equal baths by the following procedure.

Two cold 1 liter baths were prepared with:

- 0.25 g/l Versene TM (Ethylenediaminetetraacetic acid, disodium salt; sequestering agent) From Mallinckrodt Specialty Chemicals Co. in Paris, Ky.
- 0.50 g/l N 50 H (a sulfonated aromatic condensation product from the reaction of dihydroxydiphenyl sulfone and formaldehyde) prepared in the laboratory at BASF Fiber Products R&D at Enka, N.C. sulfamic acid to pH 2.0.

One sample was entered into each of the baths, heated to 85° C. and run 15 minutes at 85° C., then cooled.

Then the samples were heat treated for 1 minute at 140° C. to simulate the temperature for drying the latex backing.

Number 4 Samples

Regular acid dyeable and cationic dyeable samples were each treated in separate equal baths by the following procedure.

Cold baths were prepared with:

- 0.25 gm/l Versene TM (Ethylenediaminetetraacetic acid, disodium salt; sequestering agent) From Mallinckrodt Specialty Chemicals Co. in Paris, Ky.
- 5.7% ( on weight of carpet yarn) of 17.4% solids PMAA (polymethacrylic acid) sulfamic acid to pH 2.0.

One sample was entered into each of the baths, heated to 85° C. and run 15 minutes at 85° C., then cooled.

The samples were removed from the baths, extracted and dried in an oven at 110° C.

Then the samples were heat treated for 1 minute at 140° C. to simulate the temperature for drying of latex backing.

After these treatments, samples from each of the treated tubes were exposed to Bane-Clene TM shampoo, Bane-Clene Corporation, Indianapolis, which had been prepared according to manufacturer's directions and which had a pH of 10.0 by the following procedure in the laboratory.

A sample of knitted tube from each of the treated samples 1–4 was treated individually in a 10:1 bath ratio of Bane-Clene TM PCA Formula No. 5 Shampoo from Bane-Clene Corporation; Indianapolis, for 30 minutes at room temperature, then centrifuged using the spin cycle of a home laundry washing machine and air dried on screens at room temperature for 16 hours.

When the samples were dry, a non-shampooed sample and the shampooed sample from each of the treated samples were tested for resistance to staining by red food color by the following procedure.

Samples were treated in 10:1 bath ratios for 5 minutes at room temperature with Sauer's Red Food TM Color (Colour Index Food Red 17 or FD&C Red 40) from C. F. Sauer Company in Richmond, Va. The concentration of Sauer's Red Food Color was 2.5 grams/liter of Sauer's Red Food Color which was adapted to pH 2.8 with citric acid equals the concentration of FD&C Red 40.

The attached Table I shows the improvements obtained in red food stain resistance on the treated cationic dyeable samples after shampooing relative to cationic samples which were not treated and relative to regular acid dyeable samples.

TABLE I

| SAMPLE NUMBER | STAIN TREATMENT | YARN | RED FOOD STAIN TEST* | BANE-CLENE SHAMPOO PLUS RED FOOD STAIN TEST* |
|---|---|---|---|---|
| 1 | NONE | regular | 31.3 | 30.0 |
| 1 | NONE | cationic | 4.4 | 4.3 |
| 2 | NB-57LC | regular | 0.6 | 11.5 |
| 2 | NB-57LC | cationic | 1.6 | 0.7 |
| 3 | N 50 H | regular | 7.3 | 11.4 |
| 3 | N 50 H | cationic | 0.7 | 1.1 |
| 4 | PMAA | regular | 0.9 | 9.3 |
| 4 | PMAA | cationic | 0.4 | 0.6 |

*ACSA $\Delta E_{CIELAB}$ VALUES. The lower the $\Delta E_{CIELAB}$ value the better the stain resistance

EXAMPLE 2

Four more 50 gram samples from each of the same knitted tubes of Example 1 were numbered samples 5–8 and were treated in the laboratory by a simulated continuous application method as follows:

Each sample was treated individually in a beaker at room temperature in a 2.5:1 bath ratio by alternately soaking and squeezing until the sample was uniformly wet with the treatment bath. Then the sample was removed from beaker and steamed for 1 minute at 99° C. in a laboratory Kusters ® Steamer. After steaming, the samples were centrifuged to remove as much water as possible and dried in an oven at 110° C., then treated for 1 minute at 140° C. to simulate the temperature for drying of latex backing.

The treatment baths were as follows:

Number 5 Samples

Untreated controls

Number 6 Samples 0.25 g/l Versene TM (Ethylenediaminetetraacetic acid, disodium salt; sequestering agent) from Mallinckrodt Specialty Chemicals Co. in Paris, Ky.

4.0 g/l NB-57LC (reaction product of the polymerization or copolymerizatoion of methacrylic acid in the presence of a sulfonated aromatic formaldehyde condensation product) from BASF Corporation Parsippany, N.J.

sulfamic acid to pH 2.0.

Number 7 Samples 0.25 g/l Versene TM (Ethylenediaminetetraacetic acid, disodium salt; sequestering agent) from Mallinckrodt Specialty Chemicals Co. in Paris, Ky.

4.0 g/l N 50 H (a sulfonated aromatic condensation product from the reaction of Dihydroxydiphenyl sulfone and formaldehyde) prepared in the laboratory at BASF Fiber Products R&D at Enka, N.C.

sulfamic acid to pH 2.0.

Number 8 Samples 0.25 g/l Versene TM (Ethylenediaminetetraacetic acid, disodium salt sequestering agent) from Mallinckrodt Specialty Chemicals Co. in Paris, Ky.

4.0 g/l PMAA (polymethacrylic acid prepared in the laboratory at BASF Fiber Products R&D at Enka, N.C. from methacrylic acid using ammonium persulfate as initiator)

sulfamic acid to pH 2.0.

After these treatments samples 5–8 were exposed to Bane-Clene ® shampoo and stain tested with red food color the same as those in Example 1.

The attached Table II shows the improvements obtained in red food stain resistance on the treated cationic dyeable samples after shampooing relative to cationic samples which were not treated and relative to regular acid dyeable samples.

TABLE II

| SAMPLE NUMBER | STAIN TREATMENT | YARN | RED FOOD STAIN TEST* | BANE-CLENE SHAMPOO PLUS RED FOOD STAIN TEST* |
|---|---|---|---|---|
| 5 | NONE | regular | 30.2 | 27.7 |
| 5 | NONE | regular | 30.2 | 27.7 |
| 5 | NONE | cationic | 6.6 | 5.0 |
| 6 | NB-57LC | regular | 3.6 | 17.8 |
| 6 | NB-57LC | cationic | 1.4 | 1.2 |
| 7 | N 50 H | regular | 19.9 | 21.6 |
| 7 | N 50 H | cationic | 4.2 | 1.9 |
| 8 | PMAA | regular | 3.9 | 17.3 |
| 8 | PMAA | cationic | 0.8 | 0.9 |

*ACS $\Delta E_{CIELAB}$ VALUES. The lower the $\Delta E_{CIELAB}$ value the better the stain resistance

EXAMPLE 3

Two more 50 gram samples from each of the same knitted tubes of Example 1 were numbered samples 9 and 10 and were treated in the laboratory by a pad/dry application method to simulate a foam application as follows:

The tubes were wetted in individual baths and immediately after wetting padded through the laboratory padder at a roll pressure that had been predetermined to give a wet pick-up of 100%. The tubes were then dried in an oven at 110° C., then treated for 1 minute at 140° C. to simulate the temperature for drying the latex backing.

The treatment baths were as follows:

Number 9 Samples

Untreated controls

Number 10 Samples 0.25 g/l Versene TM (Ethylenediaminetetraacetic acid, disodium salt; sequestering agent) from Mallinckrodt Specialty Chemicals Co. in Paris, Ky.

9.9 g/l NB-57LC (reaction product of the polymerization or copolymerization of methacrylic acid in the presence of a sulfonated aromatic formaldehyde condensation product from BASF Corporation sulfamic acid to pH 2.0.

After these treatments samples 9 and 10 were exposed to Bane-Clene® shampoo and stain tested with red food color the same as those in Example 1.

The attached Table III shows the improvements obtained in red food stain resistance on the treated cationic dyeable samples after shampooing relative to cationic samples which were not treated and relative to regular acid dyeable samples.

TABLE III

| SAMPLE NUMBER | STAIN TREATMENT | YARN | RED FOOD STAIN TEST* | BANE-CLENE SHAMPOO PLUS RED FOOD STAIN TEST* |
|---|---|---|---|---|
| 9 | NONE | regular | 33.2 | 33.9 |
| 9 | NONE | cationic | 5.3 | 5.2 |
| 10 | NB-57LC | regular | 2.2 | 16.5 |
| 10 | NB-57LC | cationic | 1.6 | 4.4 |

*ACS $\Delta E_{CIELAB}$ VALUES. The lower the $\Delta E_{CIELAB}$ value the better the stain resistance

We claim:

1. A process for the manufacture of a acid stain-resistant, melt-colored carpet which retains its acid stain-resistance after shampooing with a high pH shampoo, said method comprising the steps of:

a) melt mixing a cationically dyeable polyamide copolymer, containing sulfonate groups, with a coloring agent to form a homogeneous polymer melt;

b) spinning the polymer melt into cationically dyeable fibers;

c) tufting the fibers into a backing to form a carpet; and d) treating the carpet with a compound, selected from the group consisting of polymethacrylic acid, copolymers of polymethacrylic acid, a mixture of polymethacrylic acid and a sulfonated aromatic formaldehyde condensation product, and a reaction product of the polymerization or copolymerization of a methacrylic acid in the presence of a sulfonated aromatic formaldehyde condensation product in an amount sufficient to impart acid stain-resistance retention properties to said treated carpet such that said treated carpet retains its acid-stain resistance after being subjected to shampooing with a high pH shampoo.

2. The process according to claim 1, further comprising a drawing and texturing step after spinning step (b).

3. The process according to claim 1, further comprising coating the backing with a latex.

4. The process according to claim 3, further comprising applying a secondary backing on the latex.

5. The process according to claim 1, wherein polyamide copolymers, containing sulfonate groups, being formed by copolymerization of a sulfonated aromatic dicarboxylic acid or an alkali metal salt thereof with polyamide forming monomers.

6. The process according to claim 5, wherein the sulfonated aromatic dicarboxylic acid or an alkali metal salt thereof is selected from the group consisting of 5-sulfoisophthalic acid, a sodium salt, potassium salt and lithium salt of 5-sulfoisophthalic acid.

7. The process according to claim 5, wherein the polyamide copolymer, containing sulfonate groups, is a copolymer of a nylon, selected from the group consisting of nylon 6, nylon 6/6, nylon 6/9, nylon 6/10, nylon 6T, nylon 6/12, nylon 11, nylon 12, and copolymers thereof.

8. The process according to claim 7, wherein the polyamide copolymer, containing sulfonate groups, is a copolymer of nylon 6.

9. The process according to claim 1, wherein the polyamide copolymer contains from about 0.25 to about 4.0% by weight of the sulfonated aromatic dicarboxylic acid or an alkali metal salt thereof, based on the total amount of the polyamide copolymer.

10. The process according to claim 6, wherein the coloring agent is selected from the group consisting of water-soluble dyes, organic solvent—soluble dyes, polymer soluble dyes and pigments.

11. The process according to claim 1, wherein the coloring agent is used in an amount of from about 0.001 to about 5.0% by weight, based on the total amount of polyamide copolymer.

12. The process according to claim 1, wherein the copolymers of polymethacrylic acid are formed by copolymerization of methacrylic acid and monomers selected from the group consisting of monoolefinically unsaturated acids, esters, anhydrides and amides.

13. The process according to claim 1, wherein the monomers are selected from the group consisting of acrylic acid, maleic acid, maleic anhydride, fumaric acid, alkyl acrylate, cycloalkylacrylate, hydroxyalkylacrylate, acrylamide and methacrylamide.

14. The process according to claim 1, wherein the sulfonated aromatic formaldehyde condensation product comprise condensation products of formaldehyde with sulfonated aromatic compound selected from the group consisting of 4,4'-dihydroxydiphenylsulfone, phenyl-4-sulfonic acid and mixtures thereof.

15. The process according to claim 1, wherein the carpet is treated with an aqueous solution of the compound in step (d).

16. The process according to claim 15, wherein the aqueous solution has a solid content of from about 0.1 to about 10.0% by weight.

17. The process according to claim 1, wherein in step (d) an exhaust application is used for the treatment of the carpet.

18. The process according to claim 1, wherein in step (d) a continuous application is used for the treatment of the carpet.

19. The process according to claim 1, wherein in step (d) a foam application is used for the treatment of the carpet.

20. Stain resistant melt colored carpet, obtained by the process of claim 1.

* * * * *